United States Patent [19]

Magherini

[11] 3,939,541

[45] Feb. 24, 1976

[54] MACHINE FOR MANUFACTURING, IN A CONTINUOUS AND AUTOMATIC CYCLE, STRINGS OF LIGHTS FOR MICROLAMPS

[76] Inventor: Dino Magherini, Via Osservatorio 36, Firenze, Italy

[22] Filed: June 11, 1974

[21] Appl. No.: 478,399

[30] Foreign Application Priority Data

June 13, 1973 Italy ..... 9501/73
May 31, 1974 Italy ..... 9466/74

[52] U.S. Cl. ..... 29/203 R; 29/33 F; 29/33 M; 29/203 D; 29/203 MW; 29/203 S; 29/208 R; 29/208 E

[51] Int. Cl.[2] ..... H01R 43/00

[58] Field of Search ..... 29/203 R, 203 D, 203 DT, 29/203 DS, 203 HC, 203 MW, 203 S, 208 R, 208 E, 624, 464, 527.1, 33 F, 33 M, 33 R, 628, 630 F, 630 G; 240/10 T; 317/122; 174/72 R, 72 A; 339/218 L

[56] References Cited

UNITED STATES PATENTS

| | | | |
|---|---|---|---|
| 2,955,555 | 10/1960 | Gluck | 29/208 R |
| 3,029,494 | 4/1962 | Anoren | 29/628 |
| 3,139,665 | 7/1964 | Wardell | 29/33 M |
| 3,404,453 | 10/1968 | Moranouzzo | 339/218 L |
| 3,553,813 | 1/1971 | Brown et al. | 29/203 DT |
| 3,839,787 | 10/1974 | Brown et al. | 29/203 R |

*Primary Examiner*—C. W. Lanham
*Assistant Examiner*—Joseph A. Walkowski
*Attorney, Agent, or Firm*—Haseltine, Lake & Waters

[57] ABSTRACT

Apparatus for continuously and automatically molding sockets onto an insulated flexible single pole cable comprising a deflecting mechanism for forming a series of bights in the cable, and a transfer guide for transferring the bights to a pair of spaced apart circular supports. The supports are rotated about a common axis and the various steps involved in making the sockets are performed at each bight as the two supports are intermittently rotated.

14 Claims, 20 Drawing Figures

FIG. 8
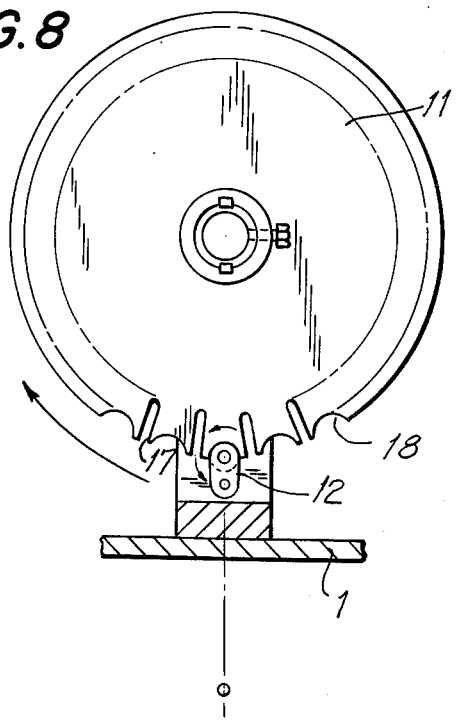
FIG. 7
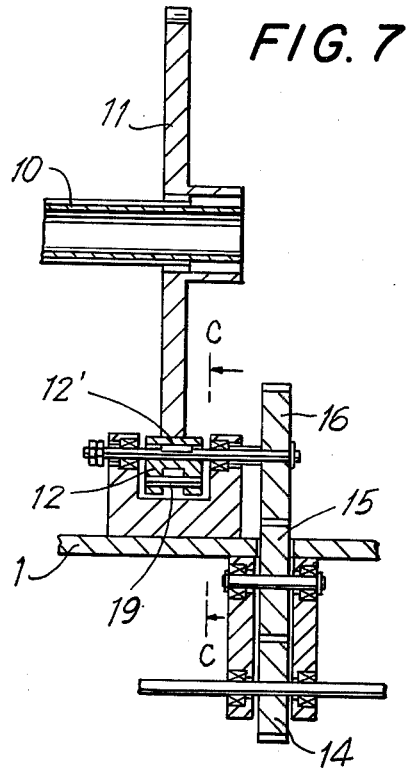
FIG. 10
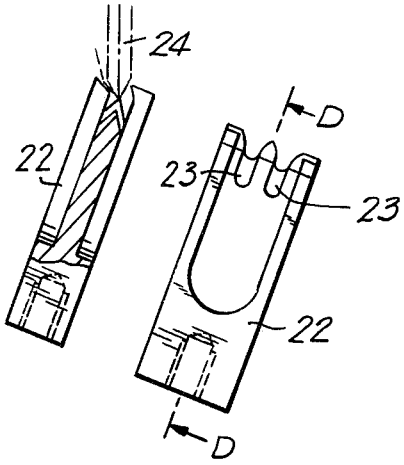
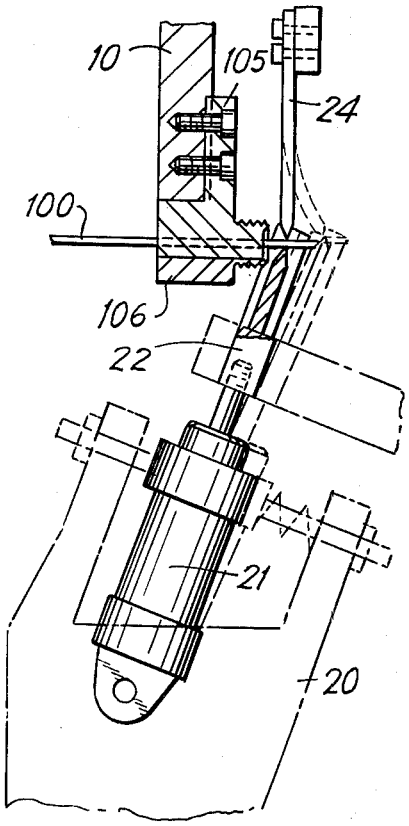
FIG. 9

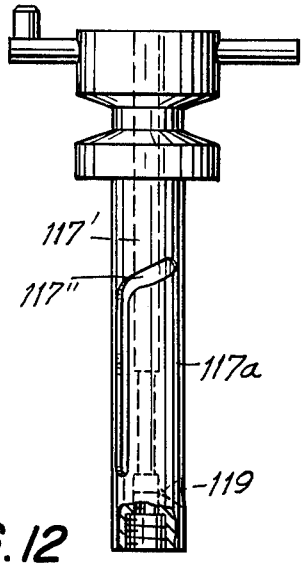
FIG. 12
FIG. 11A
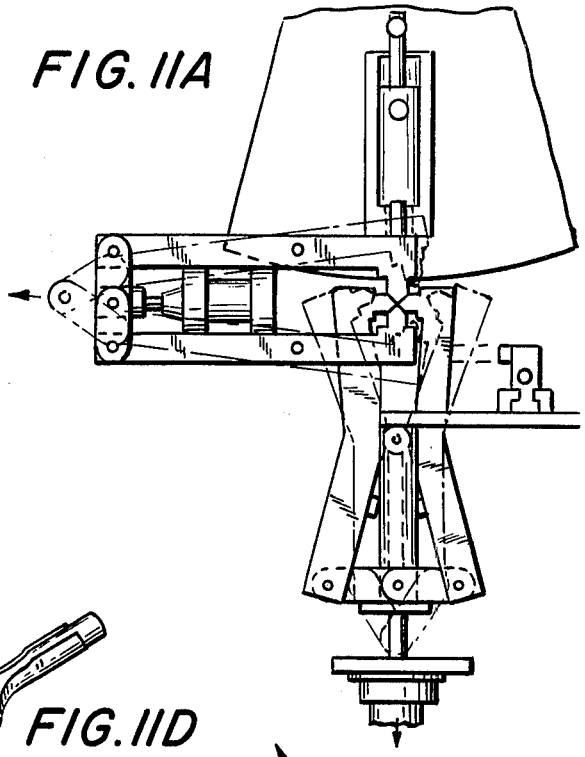
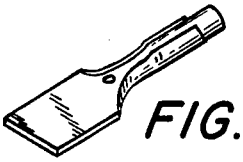
FIG. 11D
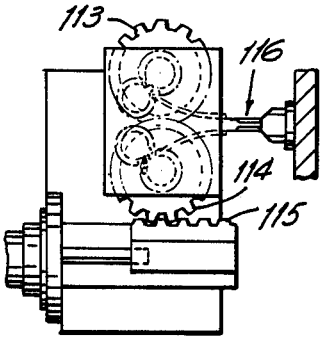
FIG. 11C
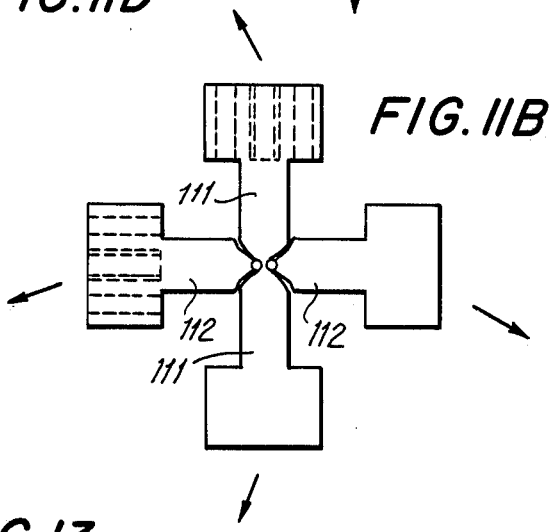
FIG. 11B
FIG. 13
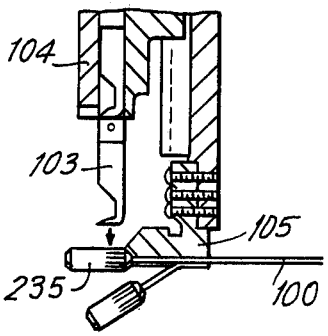
FIG. 14
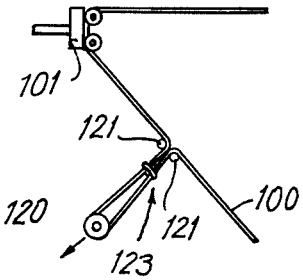
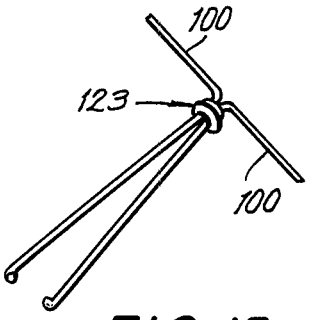
FIG. 15

MACHINE FOR MANUFACTURING, IN A CONTINUOUS AND AUTOMATIC CYCLE, STRINGS OF LIGHTS FOR MICROLAMPS

The present invention relates to a machine for manufacturing, in a continuous and automatic cycle, strings of lights using microlamps in which the sockets are molded on a single-wire conductor.

The invention provides substantially: means for distributing the flexible single-wire cable on a fretted ribbon; and on the two surfaces of the ribbon: (a) means for grasping the cable, attaching it to two equal circular and opposite supports, rotatable about a horizontal axis, and cutting it; (b) means for stripping the free ends of the conductor of said cable; (c) means for attaching, to the ends of the stripped conductor of each length of ribbon, two metal strips operating as electrical contacts of the socket; (d) means for holding said strips parallel and opposite during closure of the mold which forms the sockets; (3) means for molding the socket; (f) means for expelling the socket; and separately; (g) means for shaping a "tail" at the end of one string and at the beginning of the next; (h) means for controlling and transmitting motion to all the moving parts; (i) means for programming and synchronizing the various motions of the operative parts.

A first advantage resides in the manufacture of the string of lights with only one single-wire conductor which acts as an electrical conductor.

A second advantage is the possibility of varying at will the distance between one socket and the next and varying the number of sockets and hence the total length of the string of lights.

Another advantage consists in the possibility of performing all the operations at a constant rate; for which purpose, a particular injection of the molten thermoplastic material of which the socket will be composed is carried out at a regular rate and without interruption which makes it possible to ensure constant temperature of the material without which injection and molding could not be carried out perfectly.

A further advantage is that the "tail," i.e. the free end of the string, is formed without interrupting the working cycle, and although the conducting wire of each string is disconnected from the next string, they are still joined together without a break.

These and other advantages and characteristics will be better understood from the description hereinbelow referring to the attached drawings in which, FIG. 1 represents a cross section along a vertical longitudinal axial plane of the machine according to the invention;

FIG. 7 represents, in cross section, a detail of the elements controlling the rotation of the supports of the conductor and molds;

FIG. 8 represents a cross-sectional view taken along line CC in FIG. 7;

FIG. 9 represents, in a plan view, partly cut away, a detail of the device for stripping the conductor;

FIG. 10 represents in a plan and cross-sectional view along line DD an enlarged detail of the holder for the conductor during the stripping operation;

FIG. 11A represents, in elevation view, a detail of the device for crimping the contact strips against the stripped conductor;

FIG. 11B represents, in a lateral view, an enlarged detail of the crimping tool;

FIG. 11C represents, in elevation view, a detail of the feed of metal ribbon for making the contact strips;

FIG. 11D represents, in an axonometric view, the detail of a contact strip after crimping;

FIG. 12 represents, in elevation view, partly cut away, a further preferred device for closing a mold to form the socket;

FIG. 13 is an elevation view, partly cut away, of a device for expelling the finished socket;

FIG. 14 represents a plan view of a detail of shaping the tail of the string of lights; and FIG. 15 represents an enlargement of the detail of the tail after finishing and trimming the end.

Figure 1:
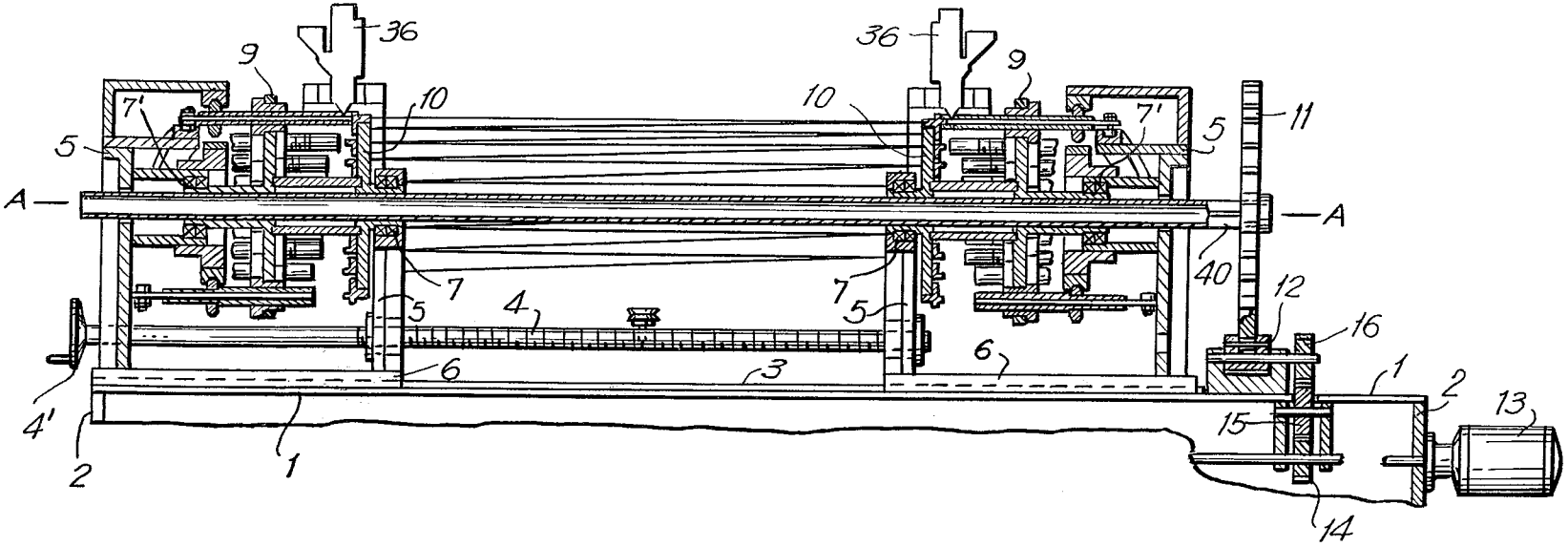

Reduced to its essential structure, the machine of the present invention, as may be seen from FIG. 1, is composed of a base formed of a longitudinal plane 1 and of several transverse beams 2 on which plane 1 a slide 3 parallel to axis AA, provided with two groups of sliding guides 5 is moved by means of a longitudinal screw 4 with a handwheel 4'; each of the two groups 5 is in turn integral with a plate 6 arranged to slide parallel to axis AA and includes two bearings 7–7' in which two circular discs 9–10 are mounted, which in turn are made integral with a longitudinal hollow 40, on which shaft a gear 11 is mounted, intended for the intermittent rotational movement of the shaft 40 by means of a crank 12 with two arms which crank is driven by an electric motor 13 through gears 14, 15, and 16 and transfers the motion to said gear 11 as long as a pin 19 engages a recess 17, while the movement is arrested whenever the head 12' of the crank 12 engages the gap 18 on gear 11.

Figure 3A:
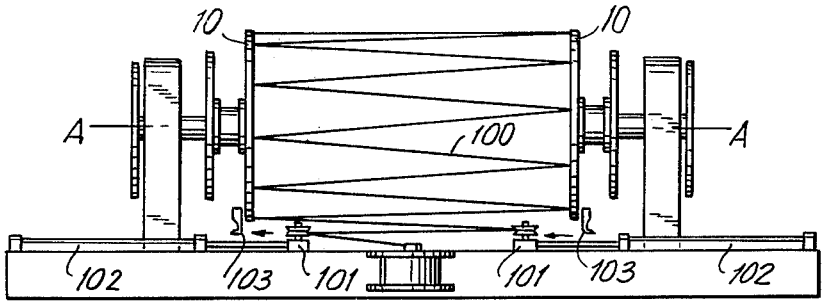
FIGS. 3A and 3B show in elevation and plan view, respectively a detail of the electrical conductor connector.
Figure 3B:
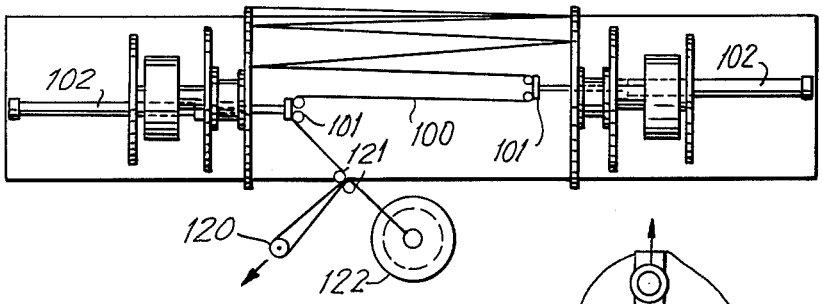

As may be seen from FIGS. 3A and 3B, there is provided two guides or deflecting mechanisms 101 for conductor 100, each of which guides preferably consists of two stretcher pulleys, said guides idling on a vertical member integral with the moving piston of a cylinder 102 driven hydrodynamically and provided with alternating intermittent rectilinear motion with operative horizontal strokes, but with different lengths for the two guides, are effected at the same time but in different directions. These mechanisms form a series of bights in cable 100 to provide a zig-zag formation between two supports 10.

Figure 4:
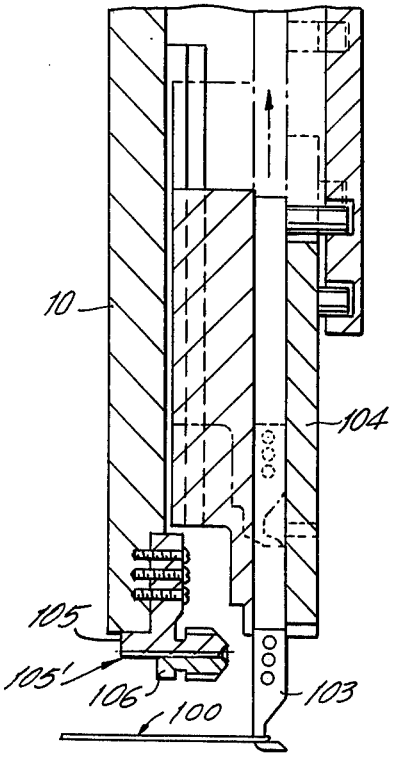
FIG. 4 represents, in cross section, a detail of a device for grasping and cutting the electrical conductor.

As may be seen from FIG. 4, there is provided on each of the two surfaces of the fretted ribbon, consisting of a large number of devices for connecting the conductor 100 to the rotating circular supports 10 each of which is composed of a hook 103 sliding in a slot in a fixed peg 104 opposite each of the supports 10 and with the direction of radial sliding movement with respect to said support 10 and at the same time transverse with respect to the axis of one section 105 of the insulation of conductor 100; means for hydrodynamic control being provided to obtain the alternating intermittent shifts of said hook where it carries out, in its centripetal stroke, the function of transferring each new length of fretted ribbon of the conductor 100 into the horizontal seat 105' of a section 105 integral with the support 10; and thereafter the function of trimming the end of said length by the action of combined cutting between the hook 103 and the peg 104.

Figure 5:
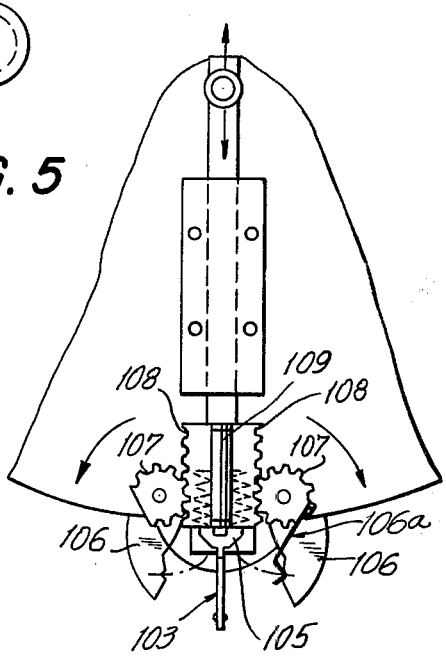
FIG. 5 represents in a side view, a detail of a device to clamp the electrical conductor.

As may be seen from FIG. 5, there is provided of as many devices to clamp conductor 100 in the respective section 105 as there are sections 105, each of which comprises a pair of pincers with two flat jaws 106 and a spring 106*a*, which jaws operate together but independently, with a small recess in each designed to crimp against the corresponding seat 105' of section 105, a portion of the conductor 100 corresponding to the length of fretted ribbon; the different rotary motion of said jaws being obtained by means of two rack-and-pinion pairs 107–108 and of which one rack is integral with one jaw 106 and one pinion is integral with a peg 109 and driven by a cam or hydrodynamically to obtain alternating rectilinear motion in the radial direction with respect to the support 10 and the centripetal stroke of which peg 109 causes the active phase, of closure, of the pincers, while the centrifugal stroke of said peg 109 causes the opening phase of the pincers.

As may be seen from FIGS. 9 and 10, there are provided of two devices for stripping the conductor or removing the insulation from the single-wire conductor 100 (one for each surface of the ribbon) in the intermediate position of the ends of the conductor protruding from section 105 after damping, each of which is composed of a peg 20 attached to the fixed frame of the machine and supporting a spring-loaded elastic hydrodynamic slave assembly 21 composed of a cutter 22 with two grooves 23; a blade 24 of steel attached at one end to the fixed frame of the machine, on the opposite side of the cutter 22 with respect to the conductor 100 and whose cutting edge is aligned with said cutter, such that when the two areas of the conductor 100 which protrude from the section 105 are disposed, according to the rotation of the supports 10, between the cutter 22 and the blade 24 and as a result of the advancement of the cutter 22 produced by 21, the electrical insulation is stripped from the copper conductor, while as the cutter retreats, the two stripped conductors 100 are released by the blade 24 and the cutter 22.

As an alternative it is possible to use an ordinary commercial wire stripper.

As may be seen from FIGS. 11A to 11D, there is provided for each of the two surfaces of the fretted ribbon, a device for attaching the contact strips to the stripped ends of the conductor, each of which includes: two pincers supported by the fixed frame of the machine, whose jaws are flat and parallel, in the closed position, and arranged to form a Greek cross; one of these pincers, i.e. the ones which move vertically, have jaws 111 without notches, but instead with a needle nose; whose sides act as an anvil for the two conductors; the other of these two pincers, i.e. the ones which move horizontally, has jaws 112 with a frontal concave notch acting as a hammer which folds the metal contact strip without cutting it; means for hydrodynamic control being provided for closing and opening the pincers; rack-and-pinion means 113, 114, 115 with a free wheel being provided for feeding the two metal ribbons in a parallel and opposite position, with hydrodynamic control; known means being provided for cutting the contacts from the continuous ribbon.

Figure 6B:
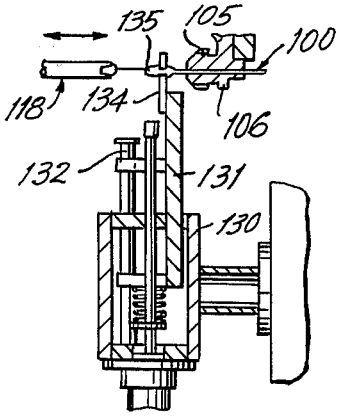
FIGS. 6A and 6B represent, in elevation and cross-sectional views, a detail of a device to support the contact strips after grasping the electrical conductor, during positioning of the male element of the mold shaping the socket.
Figure 6A:
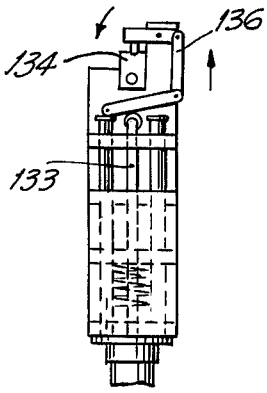

As may be seen from FIGS. 6A and 6B, there is provided for each of the two surfaces of the fretted ribbon, a plurality of devices, the same number as the number of sections 105 for supporting and guiding the electrical contacts after crimping, each of which comprises: a carriage 131 traveling on a support 130 which, at the end of the active stroke, limited by a stop 132 causes, by means of a shaft with a roller 133 which follows its advances and a lever 136, the application and squeezing of a head 134 provided with two suitable recesses, on a median portion of the two parallel and opposite contacts 135 the protruding end of said contacts being engaged by two recesses provided in the head of the male element 118 of the mold.

Figure 2:
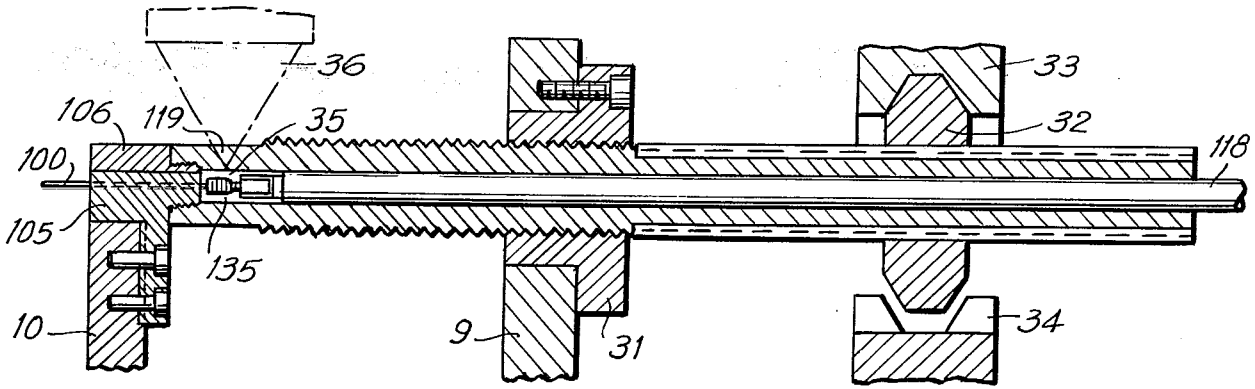
FIG. 2 represents a detail of a preferred closure device of a mold forming the socket.

As may be seen from FIG. 2, there is provided for each of the two surfaces of the fretted ribbon, a plurality of molds — the same number as of sections 105 — for shaping the sockets, each of which includes: a cylindrical female element 117, threaded on the outside and supported by a disc 9 integral with the shaft 40 by means of a socket 31 whose longitudinal axis is placed on the extension of the axis of the section 105 and whose free end is threaded on the inside and is designed to screw onto the section 105 and on the jaws 106 of the pincers for clamping the conductor by virtue of the pressure of a pulley 32 on a cam 33 and to release it by virtue of the pressure of pulley 32 on a cam 34; an aperture 119 being provided for injection — in the cavity 35 of an injector 36 — of the molten plastic destined to form the body of the socket; a male element 118 slidable in a coaxial hole 117 by hydrodynamic control.

As an alternative, the female element 117 of the mold is provided as shown in FIG. 12, 117*a*, on whose outside surface a groove provides the accommodation for a guide pin.

As may be seen in FIG. 13, each hook 103 — in its centrifugal stroke — acts as an ejector.

As may be seen in FIGS. 14 and 15, there is provided a device for shaping the tail, which comprises a tensioning device 120 with an idler pulley, mounted between a supply spool 122 for the conductor 100 and the first guide 101 for feeding the conductor 100 to the supports 10, and with interposition of two guides 121; such tensioning device 120 being set to move so as to unreel one loop 100*a* whose length corresponds to that desired for the tail which is subsequently connected with a clip or ring 123 and cut at the end. This tail serves for application of a two-pronged plug to enable the string of lights to be energized through a power cord.

The operation is as follows: while the two guides 101 distribute the flexible single-wire conductor 100 along the two surfaces of a fretted ribbon, each time the machine stops the hook 103 which is near the bottom of each of the two rotating supports 10 picks up the cable by the length of wire and transfers it to the double support 105*a* of the section itself 105 of the respective support 10; then the two-jaw pincer 106 which is at the sides of said section 105 grips the conductor on which 105 is located, after which said hook 103 cuts the conductor 100; thereafter due to the rotation of supports 10 said section 105 moves to the conductor stripping station and the blades 23–24 strip the conductor ends protruding from section 105. Thereafter the same section 105 moves across to the contact application station and the two flat-jawed pincers 111–112 crimp the two blades 135 of the contact strips cut from the two continuous metal ribbons 116; thereafter the pegs 134 and the male element 118 of the mold for forming the socket hold firmly in a parallel and opposite position said blade of the contact strips while the female element 117 of the mold screws into the section 105. At this point the mold 117–118 having made ten turns about AA comes to rest with the slot 119 under the injector 36 and the molten thermoplastic material is injected; after a further appropriate rotation, the mold 117–118 and the pincers 106 open and the hook 103 causes ejection of the solidified socket 235. After execution of a preset number of strokes of the guides 101, namely at the end of each string of lights, the tensioning device 120, as it moves, unreels one length 100*a* of conductor of preset length and forms the tail intended for application of a two-pronged plug to obtain power; known means being provided for connecting with a clip or a ring 123 and cutting the two sides of the tail at the end. After this the cycle is repeated without interruption several times for each complete rotation of supports 10, each string produced being connected by the tail to those preceding and following it.

I claim:

1. Apparatus for continuously and automatically manufacturing strings of sockets for microlamps wherein the sockets are moulded onto an insulated flexible single wire cable, said apparatus comprising: (a) deflecting means for forming a series of bights in said cable; (b) socket applying means for securing sockets to said cable at successive bights thereof; and (c) tail forming means for forming a tail in said cable following the securement of a predetermined number of sockets thereto, said tail providing the end of one string of sockets and the beginning of a subsequent string.

2. The apparatus of claim 1 further comprising a pair of spaced apart opposed supports rotatable about a common axis and wherein said deflecting means comprises means for forming said cable into a zig zag formation extending between said supports with adjacent bights thereof positioned at opposite ones of said supports, said socket applying means further comprising bight engaging and cutting means for engaging said bights in said cable, securing each bight to the adjacent one of said supports for rotation therewith and severing said cable at said bights, stripping means for stripping insulation from the free ends of said cable provided by said cutting means, contact applying means for securing electrical contacts to said free ends of said cable subsequent to their being stripped by said stripping means, clamp means for holding the pair of contacts associated with each bight in predetermined relation with respect to one another, socket mould means operable to mould a socket around said contacts, and ejection means for ejecting moulded sockets from said moulds.

3. The apparatus of claim 2 wherein said deflecting means comprises two deflecting mechanisms actuable to provide simultaneous opposite reciprocating movements in the direction of said common axis, said mechanisms having working strokes of different lengths.

4. Apparatus as defined in claim 2, wherein said bight engaging and cutting means comprises a plurality of hooks mounted on each said support at positions circumferentially spaced thereabout, said hooks being rotatable with the associated support and being movable radially relative thereto; and a plurality of gripping means mounted on each said support, in association with respective ones of said hooks, each said gripping means comprising a sector with a pair of oppositely directed seats, said hooks being operative to transfer bights in said cable from said deflecting means to said seats and to sever bights so transferred.

5. The apparatus of claim 4 wherein each said gripping means further comprises a flat pronged pincer and a spring associated with said pincer, said pincer and said spring being adapted to press said cable into said seats, and means for actuating said pincer.

6. Apparatus as defined in claim 4, wherein said ejection means comprises said hooks.

7. Apparatus as defined in claim 2 wherein said stripping means comprises chisel blades mounted on said machine at stripping stations thereof, adjacent respective ones of said supports, each chisel blade having a pair of grooves for receiving respective ones of said free ends of said cable adjacent a severed bight thereof; flexible blades mounted on said machine at respective ones of said stripping stations; and means for moving said chisel blades into engagement with said cable ends and said flexible blades so as to strip insulation from said free ends of said cables.

8. Apparatus as defined in claim 2, wherein said contact applying means comprises pincers mounted on said machine at respective contact applying stations adjacent respective ones of said supports, and contact supplying means mounted on said machine at each said applying station, said pincers being operative to crimp said contacts to said stripped free ends of said cable.

9. Apparatus as defined in claim 2, wherein said clamp means comprises a plurality of clamps mounted on each of said supports, in association with respective ones of said gripping means, said clamps being adapted to engage central portions of said contacts, and a male element of said mould means having a pair of recesses in an end thereof for reception of respective ones of two contacts.

10. Apparatus as defined in claim 2, wherein said socket mould means comprises a plurality of moulds mounted for rotation with said supports, each mould being associated with a respective one of said gripping means and comprising a female element engageable over the associated one of said gripping means, a male element slidable in said female element for engagement with an associated pair of contacts; means for engaging said female element with the associated gripping means; and injection means mounted on said machine at injection stations thereon, one such injection station being provided for each said support.

11. Apparatus as defined in claim 2, wherein said tail forming means comprises a stretcher idler engaging said cable between a storage means for said cable and said deflecting means, a pair of pulleys fixed to said machine, one engaging said cable between said stretcher idler and said storage means and the other engaging said cable between stretcher idler relative to said pulleys so as to draw out a loop in said cable, and means for tying and severing said loop.

12. Apparatus as defined in claim 2, including means for intermittently rotating said supports.

13. Apparatus as defined in claim 2, including control means operative, during each pause in the rotation of said supports to actuate: (a) said deflecting means to form two bights in said cable; (b) said bight engaging and cutting means to engage the two bights formed by the deflecting means and to transfer the bights to the supports; (c) said stripping means to strip insulation from the cable adjacent two previously severed bights; (d) said contact applying means to apply contacts to free stripped ends of said cable; (e) said socket mould means to enclose two pairs of previously applied contacts and to mould sockets around two previously enclosed pairs of contacts; said control means being operative, during each rotational movement of said supports to actuate: two of said bight engaging and cutting means to secure two previously transferred bights to said supports; said socket mould means to remove said mould means from a previously moulded socket; and said ejection means to eject two moulded sockets; said control means being operative, following the formation of a predetermined number of sockets, to actuate said tail forming means.

14. Apparatus as defined in claim 2 including means for varying the spacing of said supports.

* * * * *